US008778253B2

(12) United States Patent
Kitagawa

(10) Patent No.: US 8,778,253 B2
(45) Date of Patent: Jul. 15, 2014

(54) PROCESS FOR PRODUCING FIBER COMPOSITE MATERIAL

(75) Inventor: Tatsuya Kitagawa, Toyota (JP)

(73) Assignee: Toyota Jidosha Kabushiki Kaisha, Toyota-Shi (JP)

( * ) Notice: Subject to any disclaimer, the term of this patent is extended or adjusted under 35 U.S.C. 154(b) by 0 days.

(21) Appl. No.: 13/512,645

(22) PCT Filed: Nov. 30, 2009

(86) PCT No.: PCT/JP2009/006465

§ 371 (c)(1),
(2), (4) Date: May 30, 2012

(87) PCT Pub. No.: WO2011/064828

PCT Pub. Date: Jun. 3, 2011

(65) Prior Publication Data

US 2012/0228806 A1 Sep. 13, 2012

(51) Int. Cl.

| | |
|---|---|
| ***D01D 5/084*** | (2006.01) |
| ***D01D 5/088*** | (2006.01) |
| ***D01D 5/00*** | (2006.01) |
| ***D04H 5/00*** | (2012.01) |

(52) U.S. Cl.

CPC ..... *D01D 5/0023* (2013.01); *D04H 5/00* (2013.01)

USPC ..... 264/465; 264/171.1; 264/211.14; 264/211.15; 264/211.17; 264/510; 264/555

(58) Field of Classification Search

USPC ..... 264/171.1, 211.14, 211.15, 211.17, 264/464, 465, 466, 484, 510, 555

See application file for complete search history.

(56) References Cited

U.S. PATENT DOCUMENTS

| | | | | |
|---|---|---|---|---|
| 6,720,278 | B2 * | 4/2004 | Wenstrup | 264/122 X |
| 2010/0285101 | A1 * | 11/2010 | Moore et al. | 264/465 X |
| 2011/0004178 | A1 * | 1/2011 | Fernkvist et al. | 156/73.1 X |

FOREIGN PATENT DOCUMENTS

| | | | |
|---|---|---|---|
| JP | 64-079235 | A | 3/1989 |
| JP | 03-167358 | A | 7/1991 |
| JP | 05-293825 | A | 11/1993 |
| JP | 06-293038 | A | 10/1994 |
| JP | 07-032495 | A | 2/1995 |
| JP | 07-076276 | A | 8/1995 |
| JP | 07-076276 | B | 8/1995 |
| JP | 2003-073978 | A | 3/2003 |
| JP | 2004-122416 | A | 4/2004 |
| JP | 2007-092237 | A | 4/2007 |
| JP | 2007-126810 | A | 5/2007 |
| JP | 2007-277775 | A | 10/2007 |
| JP | 2008-291170 | A | 12/2008 |
| JP | 2008-303521 | A | 12/2008 |
| JP | 2009-057655 | A | 3/2009 |

OTHER PUBLICATIONS

International Search Report mailed Dec. 28, 2009 of PCT/JP2009/006465.

* cited by examiner

*Primary Examiner* — Leo B Tentoni
(74) *Attorney, Agent, or Firm* — Kenyon & Kenyon LLP

(57) ABSTRACT

A technique with which a nanofibrous resin spun by electrospinning can be introduced into inner parts of fibers. The process for fiber composite material production is a process which comprises spinning a nanofibrous resin toward split fibers continuously conveyed along a given conveyance route and thereby combining the split fibers with the resin to produce a fiber composite material. The process involves a resin spinning step in which the nanofibrous resin spun with an electrospinning device is flown toward the split fibers. In the resin spinning step, the direction in which the nanofibrous resin proceeds is made to be the same as the conveying direction of the split fibers by blowing an air stream from a blower on the nanofibrous resin.

3 Claims, 5 Drawing Sheets

Prior Art (b)

PROCESS FOR PRODUCING FIBER COMPOSITE MATERIAL

This is a 371 national phase application of PCT/JP2009/006465 filed 30 Nov. 2009, the contents of which are incorporated herein by reference.

TECHNICAL FIELD

The present invention relates to a technique for producing a fiber composite material formed by combining fibers with a resin.

BACKGROUND ART

In recent years, as a structural material, there has been widely used a fiber reinforced plastic (FRP), which is a fiber composite material having a strength improved by combining fibers with a resin. Examples of the fibers used therein include glass fibers, carbon fibers, aramid fibers, and polyethylene fibers.

Attention has also been paid to a technique that uses a nanofibrous resin, as a resin to be a base material (matrix) of the fiber composite material, having a fiber diameter in the order of nanometers, spun by spinning methods such as electrospinning. The electrospinning is a method of discharging a polymer dissolved in a solvent or a molten polymer into an electric field to which a high voltage is applied, thereby extending the polymer by Coulomb force to form a nanofibrous polymer.

For example, JP 2008-303521 A discloses a technique of stacking a nanofibrous polymer resin produced by electrospinning on fibers having a given surface resistivity, thereby producing a fiber composite material.

However, in JP 2008-303521 A, a resin 102 is shaped and spun toward fibers 103 by the electrospinning, there are problems as described below.

First, as illustrated in FIG. 8(*a*), the resin 102, which is a nanofibrous resin continuously spun by the electrospinning of JP 2008-303521 A, is stacked on the fibers 103 in the state where the resin 102 is oriented at random (the resin is not regularly arranged, but has irregular and arbitrary directivities). Thus, there is a problem in that the resin 102 is not introduced into inner parts of the fibers 103.

Secondly, it is known that a fiber bundle used as the raw material has a fiber-splitting (or fiber-bundle-splitting) limit, and split fibers made from the fiber bundle have such a layer form that multiple monofilaments pile up on each other. In an ordinary fiber-bundle splitting step, the monofilaments are made into a state that multiple layers are stacked on each other.

For this reason, in the case of using carbon fibers split from a fiber bundle, as the fibers 103, when the nanofibrous resin 102 is stacked on the fibers 103, the resin 102 functions merely as a bridge between monofilaments arranged in the topmost surface of a monofilament group 106 that is the split fibers 103, and the resin 102 is not introduced into the inner parts of the fibers 103 (see FIG. 8(*b*)).

For the reasons as described above, when a conventional technique is used to spin a nanofibrous resin and to combine the nanofibrous resin with split fibers, there is a problem in that the resultant fiber composite material is lacking in strength and stability.

SUMMARY OF INVENTION

Technical Problem

An objective of the present invention is to provide a technique capable of causing a nanofibrous resin spun by electrospinning to be introduced into inner parts of fibers.

Technical Solution

A process for producing a fiber composite material, in which a nanofibrous resin is spun toward a split fiber continuously conveyed along a given conveyance route, thereby combining the split fiber with the resin to produce a fiber composite material, the process including a resin-spinning step of flowing the nanofibrous resin spun by electrospinning toward the split fiber, wherein in the resin-spinning step, a direction in which the nanofibrous resin proceeds is made to be the same as a conveying direction of the split fiber by blowing an air stream on the nanofibrous resin.

The process for producing a fiber composite material preferably further includes a step of heating a composite of the split fiber and the nanofibrous resin, obtained by the resin-spinning step, to a given temperature, and a cooling step of cooling the composite heated in the heating step to a given temperature.

The resin-spinning step is preferably performed immediately after the step of splitting the split fiber.

A device for producing a fiber composite material according to the present invention is a device in which a nanofibrous resin is spun toward a split fiber continuously conveyed along a given conveyance route, thereby combining the split fiber and the resin to produce a fiber composite material, the device including: an electrospinning device which shapes the resin into the nanofibrous resin, thereby spinning the resin toward the split fiber, and a blower which blows an air stream on the nanofibrous resin shaped by the electrospinning device, to make a direction in which the nanofibrous resin proceeds to be the same as a conveying direction of the split fiber.

Advantageous Effects of Invention

According to the present invention, the nanofibrous resin spun by electrospinning is introduced into the inner parts of the fibers. Accordingly, a fiber composite material having high strength and stability is provided.

EXPLANATION OF NUMERALS

Figure 1:
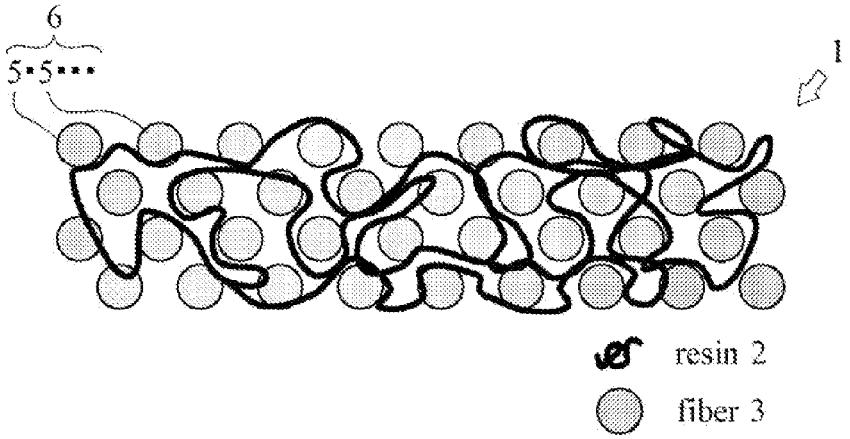
FIG. 1 is an end face view illustrating a fiber composite sheet according to an embodiment of a fiber composite material.

1: fiber composite sheet (fiber composite material)
2: resin
3: fiber
4: fiber bundle
5: monofilament
6: monofilament group (split fiber)
7: nanofibrous resin
20: electrospinning device
21: blower

DESCRIPTION OF EMBODIMENTS

With reference to FIG. 1, a fiber composite sheet 1 as an embodiment of a fiber composite material according to the invention is described below. The fiber composite sheet 1 is a sheet-form fiber reinforced plastic (FRP) in which a resin 2 is used as a base material (matrix), and the resin 2 is reinforced by combining fibers 3 as a reinforcing material with the base material.

The fiber composite sheet 1 is a lengthy member having a given width and thickness. The description will be made with the right and left direction in FIG. 1 defined as the width direction of the fiber composite sheet 1 and the upper and lower direction therein defined as the thickness direction thereof.

The resin 2 is a base material resin of the fiber composite sheet 1, and is a resin layer formed by shaping the nanofibrous resin having a diameter in the order of nanometers (about 10 nm to 100 nm) by electrospinning, and then heating and cooling the shaped resin. The present embodiment shows an example in which polyamide (PA) is used as the resin 2.

The fibers 3 are members that are combined with the resin 2 to reinforce the resin 2. The fibers 3 are made of a monofilament group 6 obtained by continuously splitting a fiber bundle 4 (see FIG. 3), conveyed as a raw material, into monofilaments 5, and arranging the monofilaments into the width direction. The present embodiment shows an example in which carbon fibers (CF) are used as the fibers 3. In this embodiment, the fiber diameter of the monofilament 5 is about 7 μm.

As illustrated in FIG. 1, in the fiber composite sheet 1, the resin 2 enters gaps between the monofilaments 5 in the state that the resin 2 is shaped into a nanofibrous resin, and is heated to be introduced into the monofilaments 5, and then cooled to be solidified. In this manner, by means of the solidified resin 2, the inner parts of the fibers 3 (between monofilaments 5) can be sufficiently bonded to each other along the thickness direction and the width direction, so that the strength of the fiber composite sheet 1 is improved and further the structure thereof is stabilized.

The carbon fibers have a fiber-splitting limit. Thus, in the fiber composite sheet 1 illustrated in FIG. 1, the four layers of the monofilaments 5 are stacked in the thickness direction in the fibers 3, as a typical example, that is, the monofilament group 6 has a four-layer structure.

The material constituting the resin 2 is not limited to polyamide in the embodiment. Any material may be used as long as the material is a thermoplastic synthetic resin that can be shaped into a resin having a diameter in the order of nanometers by electrospinning. Examples thereof include polyethylene (PE), polypropylene (PP), polyvinyl chloride (PVC), polystyrene (PS), polyvinyl acetate (PVAc), polytetrafluoroethylene (PTFE), ABS resin, AS resin, acrylic resin (PMMA), polyacetal (POM), polycarbonate (PC), modified polyphenylene ether (m-PPE), polybutylene terephthalate (PBT), polyethylene terephthalate (PET), cyclic polyolefin (COP), polyphenylene sulfide (PPS), polytetrafluoroethylene (PTFE), polysulfone (PSF), polyethersulfone (PES), amorphous polyarylate (PAR), liquid crystal polymer (LCP), polyetheretherketone (PEEK), thermoplastic polyimide (PI), polyamideimide (PAI), polylactic acid (PLA), polycaprolactone (PCL), polyglycolic acid (PGA), modified polyvinyl alcohol (modified PVA), and casein; and any copolymer thereof.

The material constituting the fibers 3 is not limited to carbon fibers in the embodiment. Any material may be used as long as the material is a fiber that can be split to some degree. Examples thereof include glass fibers, and chemical fibers such as aramid fibers and polyethylene fibers. The material may be synthetic fibers, inorganic fibers or any other chemical fibers, or natural fibers.

Examples of the synthetic fibers include nylon fibers, vinylon fibers, polyester fibers, acrylic fibers, polyolefin fibers, and polyurethane fibers.

Examples of the natural fibers include cellulose fibers and protein fibers, and examples of the inorganic fibers include glass fibers, alumina fibers, silicon carbide fibers, boron fibers, and steel fibers.

With reference to FIGS. 2 to 6, a production process 51 for producing the fiber composite sheet 1 is described. In the production process 51, the resin 2 is spun to the split fibers 3 continuously conveyed along a given conveyance route, and the resin 2 enters into the fibers 3 to be combined with the fibers 3, thereby producing the fiber composite sheet 1.

Figure 2:
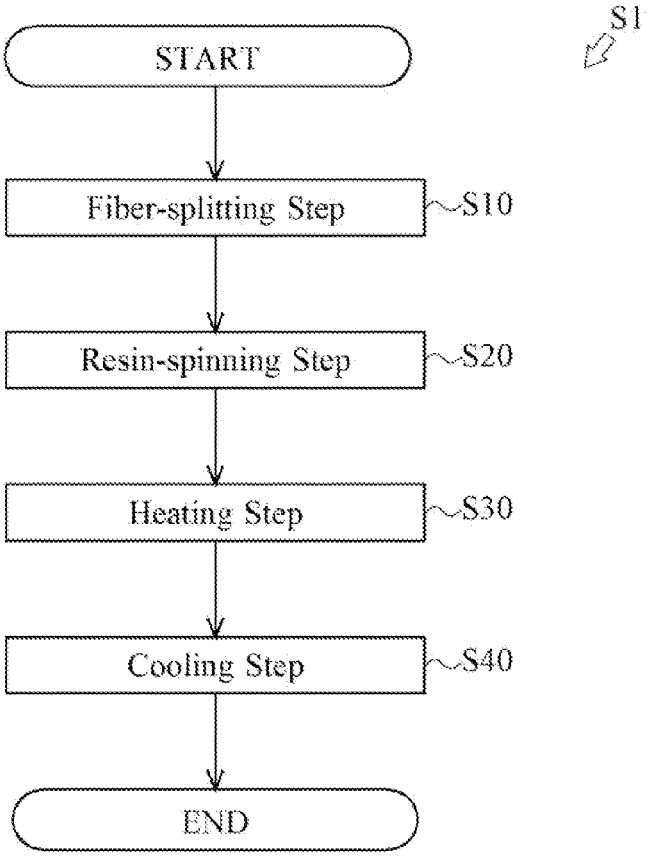
FIG. 2 is a flowchart showing steps for producing the fiber composite sheet.
Figure 3:
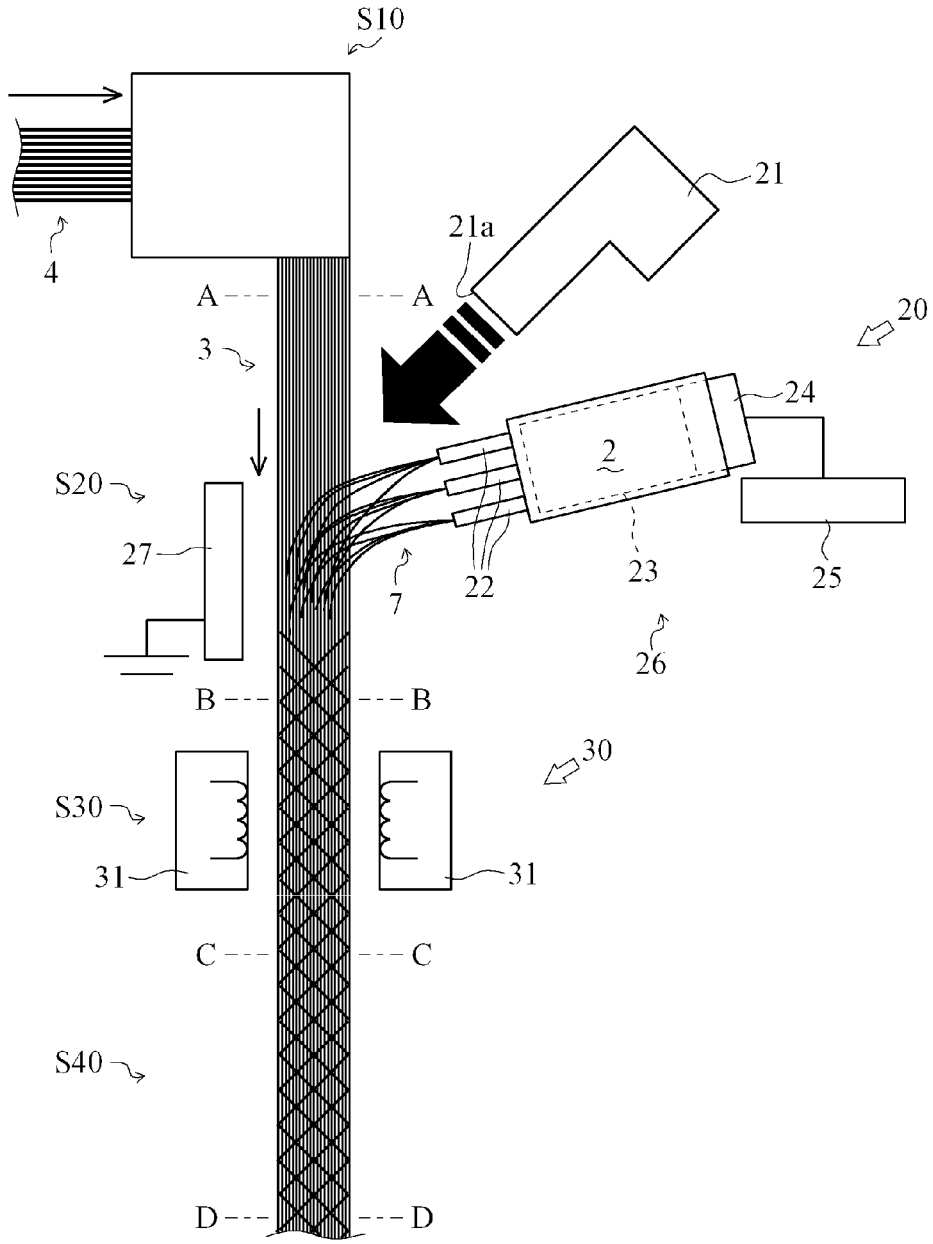
FIG. 3 schematically shows the steps for producing the fiber composite sheet, and a device used therefor.

As illustrated in FIGS. 2 and 3, the production process 51 includes a fiber-splitting step S10 of splitting the fiber bundle 4, thereby forming the monofilament group 6 as the split fibers; a resin-spinning step S20 of spinning the resin 2 into the nanofibrous resin in the state that the resin 2 is melted, thereby shaping the resin into the nanofibrous resin (hereinafter referred to as a "nanofiber resin") 7, and then causing the nanofiber resin 7 to enter the gaps in the monofilament group 6; a heating step S30 of heating a composite of the monofilament group 6 and the nanofiber resin 7 formed in the resin-spinning step S20 to re-melt the nanofiber resin 7, thereby impregnating the nanofiber resin 7 into the monofilament group 6; and a cooling step S40 of cooling the nanofiber resin 7 re-melted in the heating step S30 to be solidified, thereby forming the fiber composite sheet 1.

The fiber-splitting step S10 is a step of splitting the fiber bundle 4 formed of a number of monofilaments 5 (for example, about 12000) into a monofilament while conveying the fiber bundle 4, thereby forming the monofilament group 6 having a given dimension in the width direction thereof.

Figure 4:
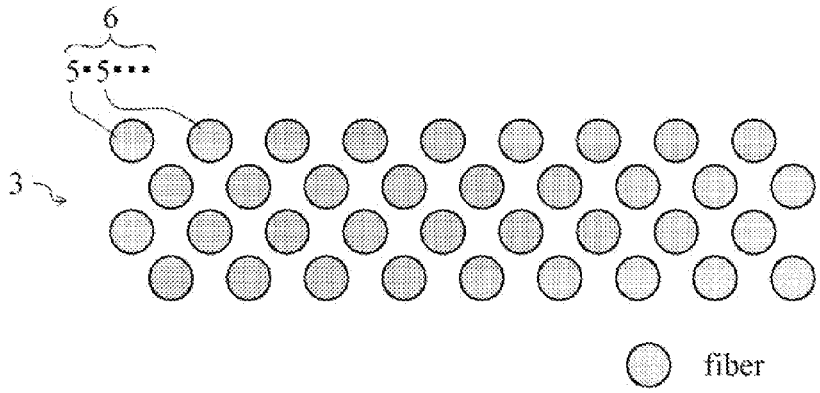
FIG. 4 illustrates a state after a fiber-splitting step, and is an end face view taken along line A-A in FIG. 3.

Since the fibers 3 are carbon fibers, the monofilament group 6, which is formed as split fibers in the fiber-splitting step S10 as illustrated in FIG. 4, has multiple layers of monofilaments 5 stacked in the thickness direction.

In the fiber-splitting step S10, a fiber-splitting device 10 is used to split the fiber bundle 4. As an example of an operation for the fiber-splitting in the fiber-splitting device 10, air splitting may be used, in which air jet is blown onto the fiber bundle 4 to split the fiber bundle 4 in a non-contact manner. This air splitting hardly gives damages (hairiness and breakage) to the fibers 3. Thus, the fiber composite sheet 1 containing the fibers 3 is prevented from damage.

It should be noticed that the splitting method is not limited to the air splitting, and may be roll splitting, bar splitting, and the like.

The resin-spinning step S20 is performed after the fiber-splitting step S10, and is a step of flowing the nanofiber resin 7 spun by electrospinning toward the monofilament group 6 (the split fibers 3) formed in the fiber-splitting step S10, thereby causing the nanofiber resin 7 to enter the inner parts of the monofilament group 6.

Figure 5:
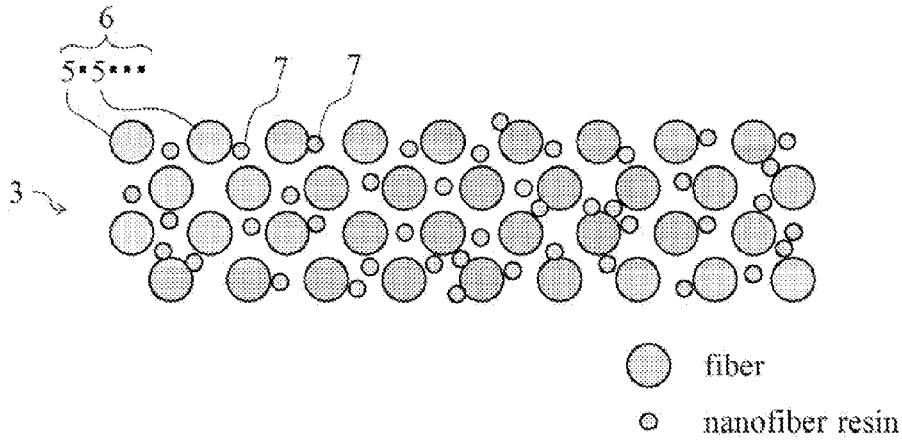
FIG. 5 illustrates a state after a resin-spinning step, and is an end face view taken along line B-B in FIG. 3.
Figure 6:
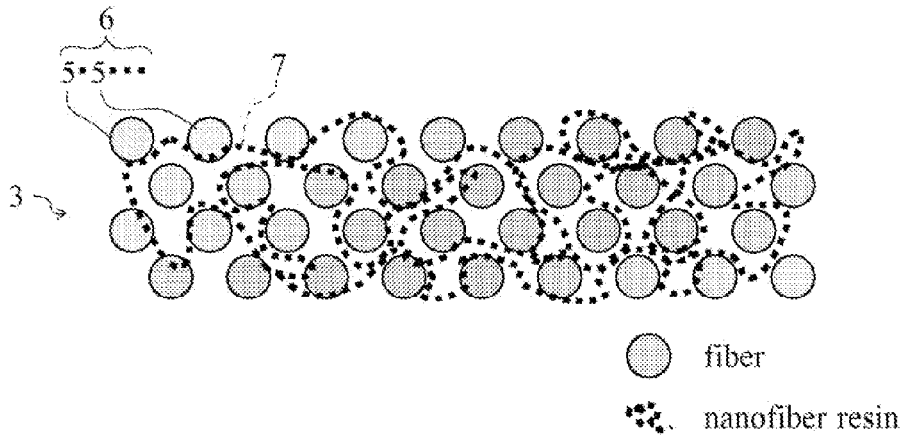
FIG. 6 illustrates a state after a heating step, and is an end face view taken along line C-C in FIG. 3.

In the resin-spinning step S20, in particular, an air stream is blown on the nanofiber resin 7 to make a direction (proceeding direction) of the nanofiber resin 7, which is oriented at random, to be the same as the conveying direction of the monofilament group 6, thereby entering the nanofiber resin 7 into the inside of the monofilament group 6 (see FIG. 5).

In the resin-spinning step S20, an electrospinning device 20 and a blower 21 are used.

In the electrospinning device 20, the resin 2 is spun into a nanofibrous resin in the state where the resin 2 is melted, or the resin 2 is dissolved in an appropriate solvent, so as to be shaped into the nanofiber resin 7. The nanofiber resin 7, shaped by the electrospinning device 20, is ejected toward the monofilament group 6.

In the blower 21, an air stream is blown on the nanofiber resin 7, which has been spun and ejected by the electrospinning device 20, to change the proceeding direction of the nanofiber resin 7, thereby making the proceeding direction to be the same as the conveying direction of the monofilament group 6.

As illustrated in FIG. 3, the electrospinning device 20 includes a main body 26 and a collector 27. The main body 26 includes: multiple nozzles 22 each of which has a discharge port at its tip and is located at the forefront of the device 20; a tank 23 which is connected to the nozzles 22 and stores the resin 2 which is in a molten state; a piston 24 for applying pressure to the inside of the tank 23 to push out the molten resin 2 from the nozzles 22; and a high-voltage device 25 for applying a high positive voltage to the resin 2 stored in the tank 23. The collector 27 is arranged opposite to the main body 26 across the monofilament group 6 (the split fibers 3) that is continuously conveyed. The collector 27 is earthed to become a target electrode for the nanofiber resin 7 which are ejected from the main body 26 in the state in which a high voltage is applied to the nanofiber resin 7.

In the electrospinning device 21, the piston 24 is operated in the state in which, from the high-voltage device 25, a high positive voltage is applied to the molten resin 2 stored in the tank 23, thereby discharging the molten resin 2 in the form of droplets from the nozzles 22.

Since the molten resin 2 discharged from the main body 26 has the high positive voltage, the resin 2 repeatedly undergoes electric repulsion to be shaped into the nanofiber resin 7 from the state of the droplets. Simultaneously, the resin 2 continuously proceeds toward the earthed collector 27 while the nanofiber resin 7 is oriented at random.

The blower 21 is connected to an appropriate air-supplying device (not illustrated), and ejects the air supplied from the air-supplying device to generate an air stream. As illustrated in FIG. 3, the blower 21 is arranged at an upstream side of the main body 26 of the electrospinning device 20 in the conveying direction of the fibers 3.

In other words, in the blower 21, an air stream directed downstream in the conveying direction is blown on the nanofiber resin 7 to change the direction in which the nanofiber resin 7 proceeds from the main body 26 toward the collector 27 to be along the conveying direction of the monofilament group 6.

As described above, in the resin-spinning step S20, the proceeding direction of the nanofiber resin 7 produced and ejected by the electrospinning device 20 is made to be the same as the conveying direction of the monofilament group 6, i.e., the split fibers, by the air stream generated by the blower 21.

Accordingly, the nanofiber resin 7 to which a directivity is given by the air stream from the blower 21 can sufficiently enter the inner parts of the monofilament group 6 without remaining at the surface of the monofilament group 6 (see FIG. 5).

At this time, the diameter of the nanofiber resin 7 is from 10 to 100 nm, and the diameter of each of the monofilaments 5, which constitute the monofilament group 6, is about 7 μm. Therefore, sufficient spaces exist around the monofilaments 5, for the nanofiber resin 7 to enter. Accordingly, the nanofiber resin 7 can easily enter the inner parts of the monofilament group 6.

As illustrated in FIG. 3, the main body 26 is arranged to be inclined, from a direction orthogonal to the conveying direction of the fibers 3 (the conveying direction of the monofilament group 6 obtained after the fiber bundle is split), toward downstream in the conveying direction. Accordingly, the direction in which the nanofiber resin 7 proceeds from the main body 26 toward the collector 27 is set to be inclined with respect to the direction orthogonal to the conveying direction.

As described above, in addition to the air stream from the blower 21, with the inclined arrangement of the main body 26 of the electrospinning device 20, the nanofiber resin 7 is easily made to proceed in the direction the same as the conveying direction of the monofilament group 6. It is therefore easy to cause the nanofiber resin 7 to sufficiently enter the inner parts of the monofilament group 6.

As illustrated in FIG. 3, the blower 21 has an ejecting port 21*a*.

The ejecting port 21*a* is a port made at the forefront of the blower 21, and ejects air toward the monofilament group 6. The size of the ejecting port 21*a* in the width direction is preferably equal to the width of the fibers 3 obtained after the fiber bundle is split. In other words, it is preferred that the length of the air stream from the blower 21 in the width direction is equal to the length of the monofilament group 6 in the width direction. This makes it possible to give a good directivity to the nanofiber resin 7 by the air stream from the blower 21, and enable the nanofiber resin 7 to efficiently enter the inner parts of the monofilament group 6.

The heating step S30 is a step of heating a composite formed by causing the nanofiber resin 7 to enter the inner parts of the monofilament group 6.

In the heating step S30, the composite is heated to a given temperature. More specifically, the composite is heated to a temperature at which the nanofiber resin 7, which is made of thermoplastic resin, melts. In this manner, the molten nanofiber resin 7 is introduced into the inner parts of the monofilament group 6 to cause the monofilaments 5 to be bonded to each other (see FIG. 6).

In the heating step S30, a heating device 30 is used.

The heating device 30 heats the composite formed of the monofilament group 6 and the nanofiber resin 7. As illustrated in FIG. 3, the heating device 30 has a pair of heaters 31 for heating the composite in a noncontact manner. The heaters 31 are arranged orthogonally to the conveying direction of the fibers 3, so as to face each other.

By adopting the noncontact heating method for the heating device 30 as described above, damages (hairiness and breakage) are less likely to be given to the fibers 3. In other words, the fiber composite sheet 1 containing the fibers 3 can be prevented from being damaged.

It should be noted that any heating method can be used in the heating device 30 as long as it is a method that gives less damage onto the fibers 3, and the heating method is not limited to the heating method of the present embodiment. The heating method may be, for example, a roller-type heating method in which the fibers 3 are sandwiched, along the thickness direction, between the heated paired rollers. In this case, the air present between the monofilaments 5, which constitute the monofilament group 6, is pushed out by the pressure from the rollers, so that generation of gaps can be prevented inside the fiber composite sheet 1. Accordingly, the strength and stability of the fiber composite sheet 1 can be improved.

The cooling step S40 is a step of cooling the nanofiber resin 7 introduced into the inner parts of the monofilament group 6 in the molten state, so as to be solidified.

Figure 7:
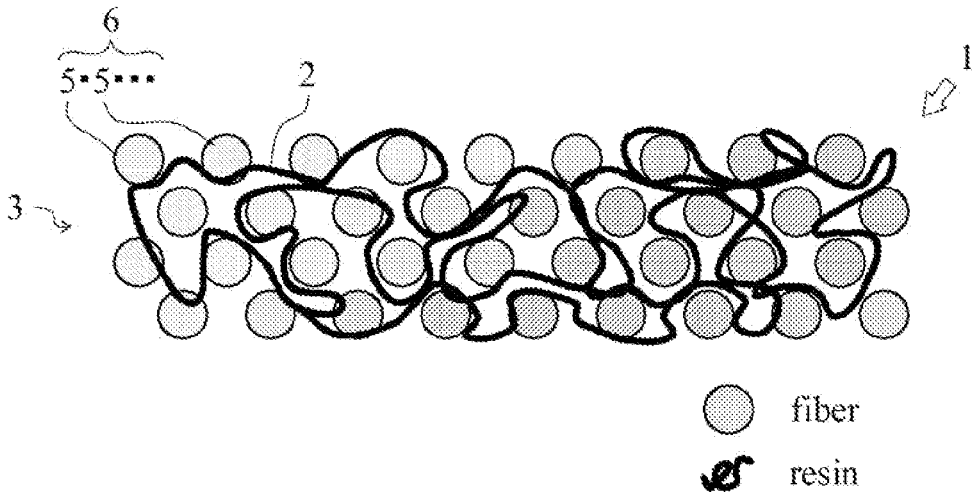
FIG. 7 illustrates a state after a cooling step, and is an end face view taken along line D-D in FIG. 3.
Figure 8:
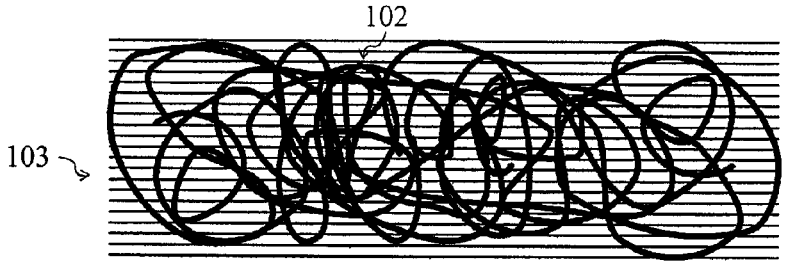
FIG. 8 Prior Art
FIG. 8 illustrates a fiber composite material obtained by a conventional process for producing a fiber composite material, where FIG. 8(*a*) is a plan view thereof, and FIG. 8(*b*) is an end face view thereof.
Figure 8:
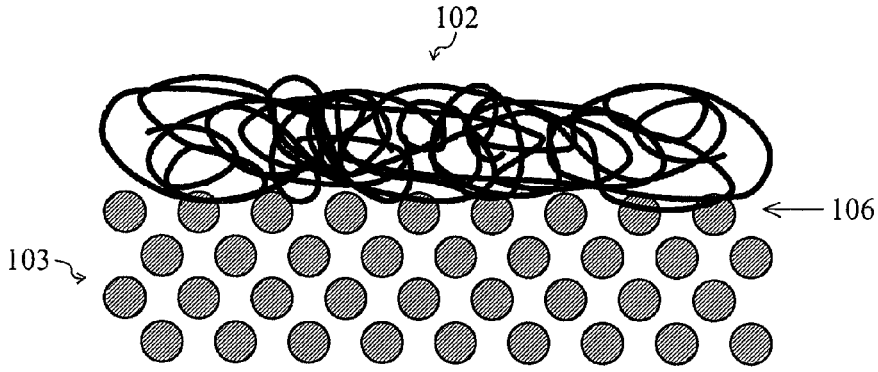
FIG. 8 Prior Art

In the cooling step S40, the nanofiber resin 7 is cooled to a temperature at which the nanofiber resin 7 is solidified, whereby the nanofiber resin 7 introduced between the monofilaments 5 is solidified to function as the resin 2 to bond the monofilaments 5 to each other (see FIG. 7).

In the cooling step S40, the monofilament group 6 and the nanofiber resin 7 are exposed to room temperature in the middle of the conveyance route and cooled.

Thus, the cooling period in the cooling step S40 is equal to the conveying period. For this reason, the conveyance route is set to a length necessary for sufficiently solidifying the nanofiber resin 7.

It should be noted that, in the cooling step S40, a configuration of using an appropriate cooling means, such as blowing of cold wind, to cool the nanofiber resin 7 forcibly may be adopted. In this case, the time required for the cooling step S40 can be shortened.

As described above, after the nanofiber resin 7 has been subjected the cooling step S40, the nanofiber resin 7 is solidified in the state of being introduced into the inner parts of the monofilament group 6 (the fibers 3 after the fiber bundle 4 is split), and the resin 2 for bonding the monofilaments 5 to each other is formed. In this manner, the fiber composite sheet 1 is obtained in which the resin 2 is impregnated in the fibers 3.

As described above, the fiber composite sheet 1 produced by the production process S1 has high strength and stability.

Since the fiber-splitting step S10, the resin-spinning step S20, the heating step S30, and the cooling step S40 are performed on the fibers 3 in a noncontact state, damages to the fibers 3 can be suppressed to a minimum level.

Immediately after the fiber-splitting step S10, the resin 2 is spun in the resin-spinning step S20 so that the fibers 3 and the resin 2 are combined with each other. Thus, the split fibers 3 are not easily closed, and the fiber composite sheet 1 that is stable in the width direction can be produced.

The fiber composite sheet 1 obtained through the cooling step S40 is wound by an appropriate winding device (not illustrated).

The wound fiber composite sheet 1 is cut into an appropriate length, and a plurality of fiber composite sheets 1 are stacked onto each other with an arbitrary angle. By pressing the fiber composite sheets 1 along the thickness direction, a plate member having the fiber composite sheets 1 stacked on each other is formed. By subjecting the plate member to press working or the like, a product using the fiber composite sheets 1 is produced.

In this case, as described above, since the fiber composite sheet 1 has high strength and stability, the product is good in handleability, and has an advantage in that the product can easily be used in a step after the above-mentioned product producing process or the like.

Applications as described below can be made to the electrospinning device 20 used in the resin-spinning step S20.

By controlling the operating speed of the piston 24 of the electrospinning device 20, the shaping rate of the nanofiber resin 7 can be adjusted. In other words, adjustment can be made on the amount of the nanofiber resin 7 caused to enter the monofilament group 6 that is conveyed at a constant speed.

This makes it possible to freely adjust the amount of the resin 2 contained in the fiber composite sheet 1 to be produced, so as to easily give a high-and-low distribution of the strength to the fiber composite sheet 1.

The electrospinning device 20 may include a plurality of tanks 23, 23, . . . which store resins 2*a*, 2*b*, . . . having difference properties, respectively, and nanofiber resins 7*a*, 7*b*, . . . of different types can be ejected from respective nozzles 22, 22, . . . of the tanks 23, 23, . . . .

This makes it possible to produce a fiber composite sheet 1 containing the plurality of types of resins 2*a*, 2*b*, . . . , thereby providing a fiber composite material having respective functional properties of the resins. The contained amount of the resins can be easily adjusted by the above-mentioned method.

Functional molecules (electroconductive molecules, catalyst, or the like) may be dispersed in the molten resin 2 stored in the tank 23.

This makes it possible to give a function uniformly to the nanofiber resin 7 shaped by the electrospinning device 20.

INDUSTRIAL APPLICABILITY

The present invention is applicable to a technique for producing a fiber composite material formed by combining a resin with fibers, and particularly to a case where a resin spun by electrospinning is combined with fibers and a case where split fibers are formed to have a plurality of layers.

The invention claimed is:

1. A process for producing a fiber composite material, in which a nanofibrous resin is spun toward a split fiber continuously conveyed along a given conveyance route, thereby combining the split fiber with the resin to produce the fiber composite material, the process comprising:

a resin-spinning step of flowing the nanofibrous resin spun by electrospinning toward the split fiber by means of an electrospinning device, wherein, in the resin-spinning step, a direction in which the nanofibrous resin proceeds is made to be the same as the conveying direction of the split fiber by blowing an air stream on the nanofibrous resin by means of a blower arranged at an upstream side of the electrospinning device.

2. The process according to claim 1, further comprising:

a step of heating a composite of the split fiber and the nanofibrous resin, obtained by the resin-spinning step, to a given temperature, and a cooling step of cooling the composite heated in the heating step to a given temperature.

3. The process according to claim 1, wherein the resin-spinning step is performed immediately after the step of splitting the split fiber.

* * * * *